United States Patent [19]

Kerckhoff

[11] 4,423,685

[45] Jan. 3, 1984

[54] CRANE TROLLEY

[75] Inventor: Wilhelm Kerckhoff, Herdecke, Fed. Rep. of Germany

[73] Assignee: Mannesmann Aktiengesellschaft, Dusseldorf, Fed. Rep. of Germany

[21] Appl. No.: 288,482

[22] Filed: Jul. 30, 1981

[30] Foreign Application Priority Data

Aug. 16, 1980 [DE] Fed. Rep. of Germany ..... 3030929

[51] Int. Cl.[3] ..... B61F 9/00; B61B 13/04; E05D 13/02

[52] U.S. Cl. ..... 105/150; 105/144; 105/148; 16/91; 16/102; 16/106; 104/93; 104/119; 104/247

[58] Field of Search ..... 105/141, 144, 145, 150, 105/152, 153, 154, 155, 156, 148; 104/89, 91, 93, 95, 96, 98, 101, 106, 110, 119, 120, 118, 172 S, 242–248; 198/678, 838, 845; 16/91, 97, 102, 104, 106, 107, 105, 90

[56] References Cited

U.S. PATENT DOCUMENTS

| | | | |
|---|---|---|---|
| 1,043,793 | 11/1912 | Barnes | 105/145 |
| 2,845,877 | 8/1958 | Richter | 105/156 |
| 3,625,158 | 12/1971 | Lorenz et al. | 105/150 |
| 3,727,560 | 4/1973 | Blemly et al. | 104/247 |
| 3,844,224 | 10/1974 | Ishii et al. | 104/247 |
| 3,902,432 | 9/1975 | Shortridge | 105/150 |
| 4,164,187 | 8/1979 | Kaufman | 105/150 |
| 4,182,243 | 1/1980 | Ceauselu | 105/154 |

FOREIGN PATENT DOCUMENTS

| | | | |
|---|---|---|---|
| 1808210 | 3/1977 | Fed. Rep. of Germany . | |
| 2353622 | 4/1977 | Fed. Rep. of Germany . | |
| 2503487 | 5/1978 | Fed. Rep. of Germany | 105/150 |
| 583760 | 12/1946 | United Kingdom | 104/247 |

*Primary Examiner*—Robert B. Reeves
*Assistant Examiner*—Donald Hajec
*Attorney, Agent, or Firm*—Mandeville and Schweitzer

[57] ABSTRACT

A novel crane trolley has four guiding pulleys lying on opposed upper and lower guiding surfaces, arranged diagonally to eliminate the need for having eight guiding pulleys. On each side of the trolley are upper and lower guiding pulleys, with the lower in front on one side and the upper in front on the other side. The pulleys may be mounted under spring tension. Two such trolleys may be hinged together to support heavy loads.

10 Claims, 7 Drawing Figures

CRANE TROLLEY

BACKGROUND OF THE INVENTION

The invention relates to a crane trolley with at least one carrying wheel and guiding pulleys that are assigned to said wheel and which lie closely against guiding surfaces of a beam, these surfaces being superimposed on each other and preferably vertical.

A crane trolley of this type is known from DE-AS No. 23 53 622, having for each carrying wheel or carrying-wheel pair eight guiding pulleys, which guide the crane trolley in the linear and curved beam area accurately along the guiding surfaces of the beam carrier. In case of a crane trolley with a carrying wheel designed as a diabolo roller as in DE-AS No. 18 08 210, the diabolo roller replaces the upper guiding pulleys so that only four lower guiding pulleys are required for a chassis. In case of a very curved beam carrier, crowding occurs between the edge of the diabolo roller and the upper guiding surfaces of the beam carrier, and also between the lower guiding surfaces of the beam carrier and the lower guiding pulleys. This crowding can be avoided only by having a long distance between the guiding surfaces and the guiding pulleys. However, under these conditions, the guiding pulleys no longer guide the crane trolley sufficiently well along a linear stretch. Imprecise guidance signifies that the power feeder becomes expensive, and that, in order to control the crane trolley, only switching devices may be used which allow for a very long switch distance and which are therefore very expensive.

SUMMARY OF THE INVENTION

The object of the present invention is, therefore, to design a crane trolley that it may be accurately guided, with minimal expenditure, along the beam carrier. This objective is achieved by having two guiding pulleys diagonally facing each other on the crane trolley for the upper and lower guiding surfaces, so that imaginary connecting lines cross each other between all guiding pulleys. Only a total of four guiding pulleys are required to provide accurate upper and lower guidance, i.e., on each side one upper and one lower, in which one is arranged at the front end and the other at the rear end of the crane trolley. No guiding pulleys face each other directly. The upper and lower guiding pulleys prevent the crane trolley from tipping at the beam carrier, and the front guiding pulleys, together with the rear ones, assure that the crane trolley is guided accurately in the longitudinal direction of the beam carrier. Thus, while providing accurate guidance, half of the otherwise customary guiding pulleys are eliminated. A small space of approximately 1 mm may be left between the guiding surface and the guiding pulleys in order to balance tolerances in the distance of the guiding surfaces of the beam carriers from each other. This space may be somewhat smaller for apparatus with large radii, and somewhat larger for apparatus with very narrow radii.

A further aspect of the present invention is that the upper and lower guiding pulleys may be arranged with their axes in bore holes of longitudinal plates. In that case, the upper and the lower longitudinal plates are connected with each other via a vertical I-beam girder which may be designed as a torsion-rod spring.

Another aspect of the invention is that the upper guiding pulleys are connected with each other via a longitudinal girder having, at the longitudinal-side ends facing the guiding rollers, vertical I-beam girders for the lower guiding pulleys, in which the I-beam girders may be designed as flat springs. When the I-beam girder is designed as a torsion-rod spring or flat spring, this space between the guiding surfaces and the guiding pulleys need not be present since, if necessary, the springy I-beam girder allows for the guiding pulleys to give. Furthermore, the axes of the guiding pulleys may be displaceably arranged in the longitudinal girders under the pressure of springs directed toward the guiding surfaces. In any conceivable structural design of the crane trolley, four of the previously customary eight guiding pulleys are eliminated without impeding the trolley's traveling behavior.

For transporting larger loads, interconnecting crane trolleys, moving in the drive direction, may be hinged to each other.

Three exemplary embodiments of the present invention are illustrated in the drawings and further detailed below.

DETAILED DESCRIPTION OF THE INVENTION

Figure 1:
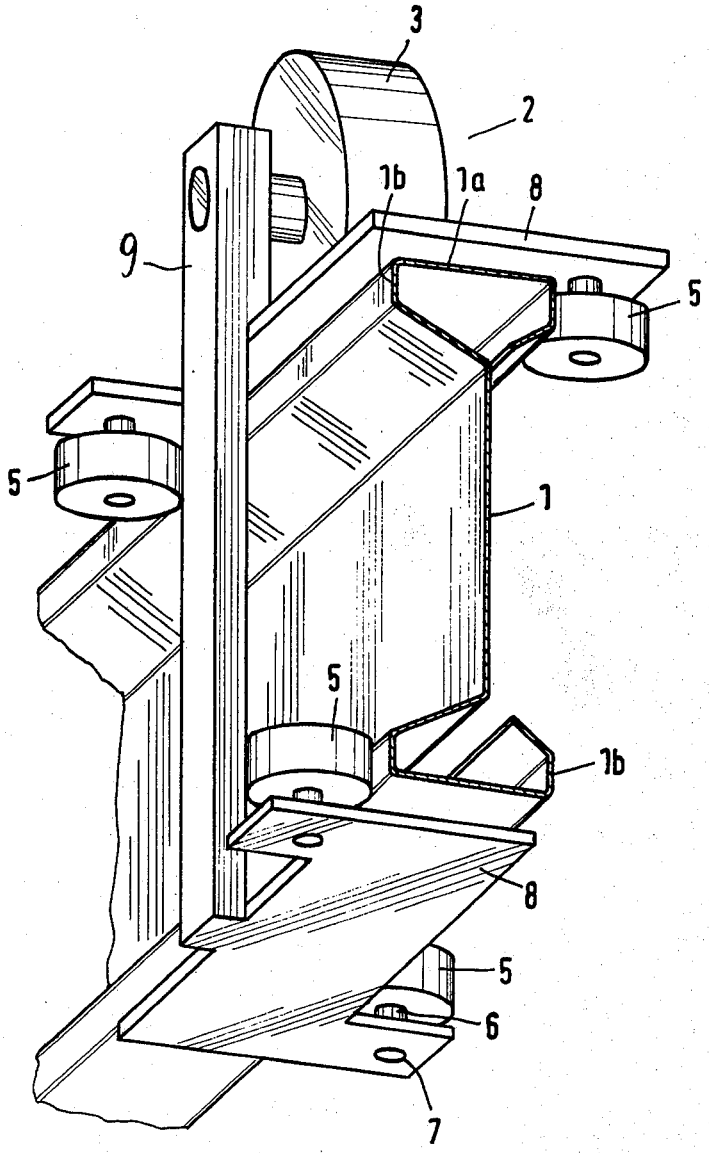
FIG. 1 is a perspective view of a crane trolley arranged at a beam carrier.

In the exemplary embodiments, a crane trolley 2 with a trailing wheel 3 runs on the tread 1*a* of the beam 1. This wheel is powered with the exception of the rear crane trolley according to FIG. 5 by a traction motor 4. Guiding pulleys 5 of crane trolley 2 lie minimally spaced from each other against upper and lower vertical guiding surfaces 1*b* of the beam 1.

Figure 2:
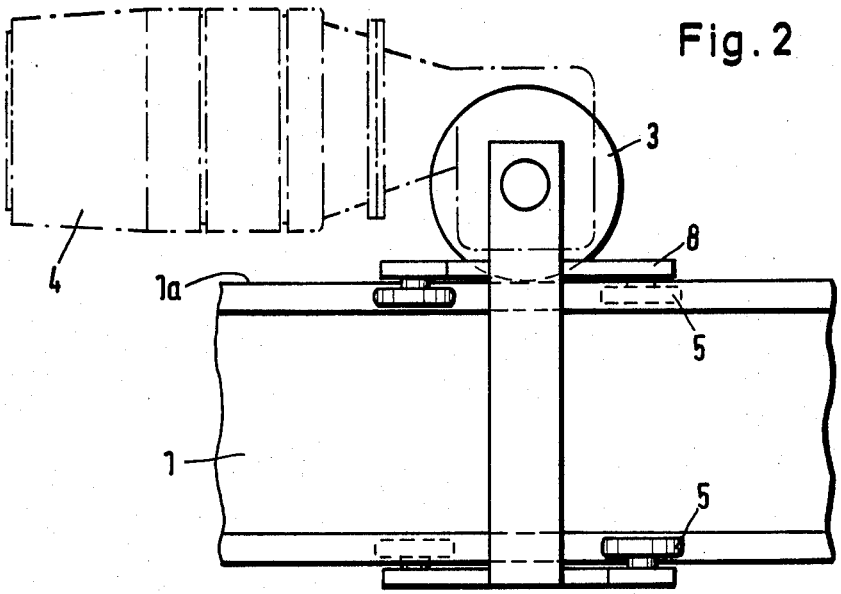
FIG. 2 is a side-elevational view of a partial element of a beam with a simple crane trolley.
Figure 3:
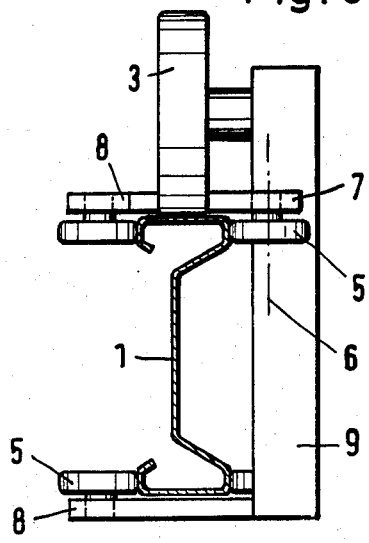
FIG. 3 is a frontal view of FIG. 2, but without traction motor.

The guiding pulleys in FIG. 2, upper right and lower left, are represented by dashes, and the guiding pulleys at the lower right and the upper left, are indicated by full lines, i.e., the first-named are behind the beam 1. Acting alone, these four, the two visible and the two invisible guiding pulleys 5, assure accurate guidance of the crane trolley 2 on the beam 1. Longitudinal plates 8, with bearing bore-holes 7 for the axes 6 of the guiding pulleys 5, are shown above and below the beam 1 as shown in FIGS. 1 to 3. A vertical I-beam girder 9 leads from the upper longitudinal plate 8 to the longitudinal girder. The upper longitudinal plate 8 has a recess for the trailing wheel 3 for rolling off onto the tread 1*a*.

Figure 4:
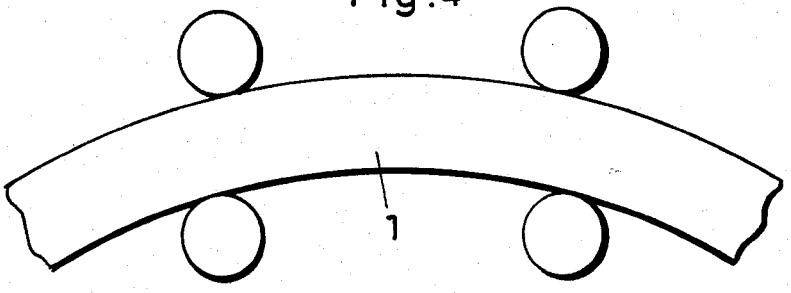
FIG. 4 is a top view of a curved beam with guiding pulleys.

FIG. 4 shows the beam 1 exaggeratedly curved. This figure clearly shows that any guides present in the center of a carriage—whether treads or other guiding pulleys—would lead to crowding.

Figure 5:
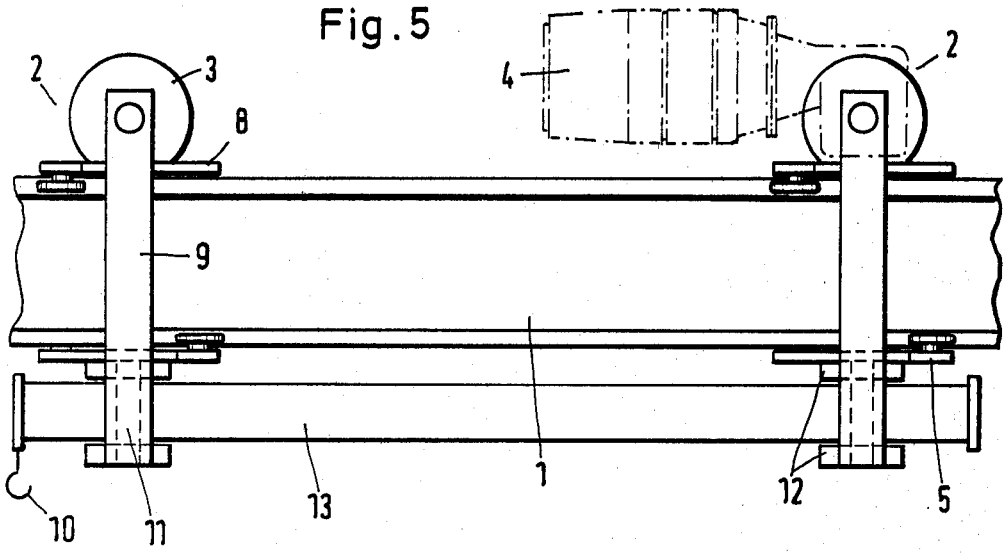
FIG. 5 is a side-elevational view of a partial element of a beam with a double crane trolley.
Figure 6:
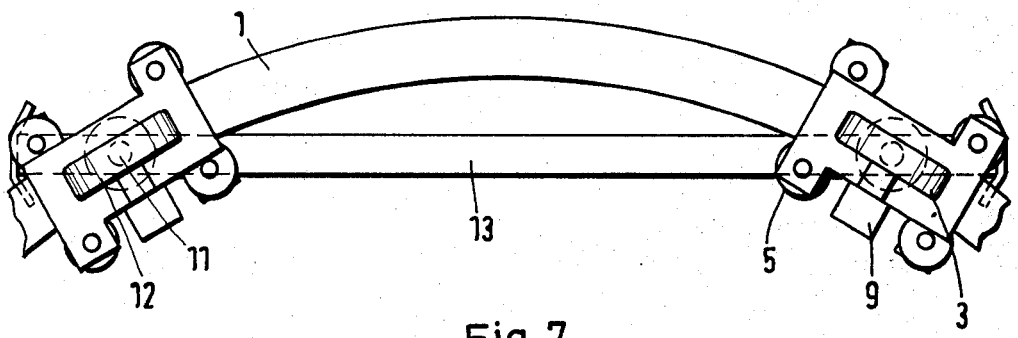
FIG. 6 is a top view of FIG. 5.

The exemplary embodiment disclosed in FIGS. 5 and 6 shows the crane trolleys 2 to have vertical pins 11, below the longitudinal plate 8 fastened to the I-beam girder 9, for bearing eyes 12 of a load carrier 13 which extends beyond the crane trolleys 2, with eyes 10 at its end for hooking in longer elements.

Figure 7:
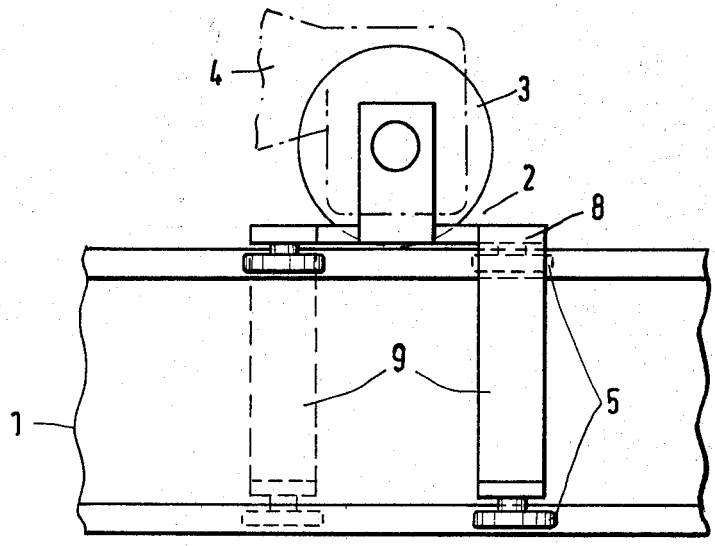
FIG. 7 is another one-wheel crane trolley.

The crane trolley according to FIG. 7, with indicated traction motor 4, has only an upper longitudinal plate 8 with two I-beam girders 9 for the lower guiding pulleys 5, of which the one illustrated on the right lies in front of the beam 1.

I claim:

1. A crane trolley adapted to guide a carrying wheel along a beam, of the type having guide pulleys lying against upper and lower guide surfaces of said beam, the improvement comprising (a) only two upper guiding pulleys arranged diagonally facing each other at the upper guide surface, (b) only two lower guiding pulleys arranged diagonally facing each other at the lower guide surface and also placed diagonally from said upper guiding pulleys, (c) said upper and lower guiding pulleys lying closely against said upper and lower guide surfaces, respectively, (d) whereby imaginary connecting lines drawn between said four guiding pulleys would cross each other between said pulleys.

2. Crane trolley according to claim 1, wherein there is a space between the guide surfaces and the guiding pulleys.

3. Crane trolley according to claim 2, wherein the space is approximately 1 mm long.

4. Crane trolley according to claim 1, further comprising (a) upper and lower longitudinal plates, having bore holes, (b) said upper and lower guiding pulleys being supported on said upper and lower plates by having axes mounted in said bore holes, (c) a vertical I-beam girder connecting said plates.

5. Crane trolley according to claim 4, wherein the vertical I-beam girder is developed as a torsion-bar spring.

6. Crane trolley according to claim 1, further comprising (a) a horizontal, longitudinally extending girder connecting said upper guiding pulleys, (b) said horizontal girder having ends adjacent to and facing said upper pulleys, (c) a vertical I-beam girder mounted upon each of said ends, (d) said vertical I-beam girders are adapted to support axes of said lower guiding pulleys.

7. Crane trolley according to claim 6, wherein said vertical I-beam girders are designed as flat springs.

8. Crane trolley according to claim 4, wherein (a) said axes are mounted in said bore holes under spring tension, (b) said axes further being displaceable in the direction of said guiding surfaces.

9. Crane trolley according to claim 1, further comprising (a) two of said trolleys being hinged together by a load carrier, (b) whereby the interconnecting trolleys move together in a drive direction.

10. A crane trolley according to claim 1, wherein said pulleys are mounted under spring tension.

* * * * *